US008177586B2

(12) United States Patent
Däschner et al.

(10) Patent No.: US 8,177,586 B2
(45) Date of Patent: May 15, 2012

(54) CONNECTOR SYSTEM

(75) Inventors: Heiko Däschner, Leutenbach (DE); Rolf Walter, Waiblingen (DE); Michael Schneider, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 46 days.

(21) Appl. No.: 12/801,928

(22) Filed: Jul. 2, 2010

(65) Prior Publication Data

US 2011/0003516 A1 Jan. 6, 2011

(30) Foreign Application Priority Data

Jul. 4, 2009 (DE) ..... 10 2009 031 706

(51) Int. Cl.
*H01R 13/642* (2006.01)

(52) U.S. Cl. ..... 439/680

(58) Field of Classification Search ..... 439/680, 439/681, 589, 320, 901, 34, 271, 275, 677
See application file for complete search history.

(56) References Cited

FOREIGN PATENT DOCUMENTS

DE 2 248 268 4/1974

*Primary Examiner* — Alexander Gilman
(74) *Attorney, Agent, or Firm* — Walter Ottesen; Christian Ottesen

(57) ABSTRACT

A connector system (1) includes a plurality of connectors (39 to 45) which each have a plug and a counter plug. Each plug has a plurality of receptacles (29, 30) for contacts and each counter plug has a plurality of receptacles (29, 30) for counter contacts. In at least one receptacle (29, 30) of each plug, a contact is arranged and in at least one allocated receptacle (29, 30) of each counter plug, an allocated counter contact is arranged. In at least one of the connectors (39 to 45), at least one receptacle of a plug does not have a contact. In the allocated receptacle (29, 30) of the counter plug, a coding element is arranged which prevents the insertion of a contact into this receptacle (29, 30) of the counter plug.

17 Claims, 3 Drawing Sheets

CONNECTOR SYSTEM

CROSS REFERENCE TO RELATED APPLICATION

This application claims priority of German patent application no. 10 2009 031 706.6, filed Jul. 4, 2009, the entire content of which is incorporated herein by reference.

FIELD OF THE INVENTION

This invention relates to a connector system which includes more than one connector.

BACKGROUND OF THE INVENTION

In a connector system it must be ensured that each plug and counter plug are correctly assigned to each other. To achieve a correct assignment it is known from German Patent 2 248 268 A1 to provide multiple grooves on the housing of the socket part and a protrusion on the corresponding plug part which permits insertion of the plug part only into the corresponding socket part. For this purpose, specially configured connector housings have to be used which permit coding of the plug and counter plug.

SUMMARY OF THE INVENTION

The object of the invention is to provide a connector system of the kind referred to above which enables a simple assignment of plug and counter plug without a special configuration of the housing.

The connector system of the invention includes: a plurality of connectors; each of the connectors having a first plug and a second plug as a counter plug for the first plug; each of the first plugs having a plurality of first receptacles for contacts; each of the second plugs having a plurality of second receptacles for counter contacts; at least one of the first receptacles of each of the first plugs having a first contact mounted therein; at least one of the second receptacles of each of the second plugs assigned to the one of the first receptacles having a second contact mounted therein as a counter contact to the first contact; at least one of the first receptacles of the first plug of the at least one of the connectors being without a first contact; and, the one second receptacle of the second plug of the one connector corresponding to the one first receptacle having a coding element for blocking the insertion of a contact into the one second receptacle.

According to an embodiment of the invention an unused contact is used for coding. For example, unused contacts result when using standard plugs wherein not always the maximum available number of contacts is needed. At least one unused contact is used and a coding element is arranged on the corresponding receptacle of the counter contact which prevents the insertion of a plug which does not have this unused contact. The term receptacle in the present application characterizes here the location at which a contact or counter contact can be arranged. This is irrespective of whether a contact or a counter contact is actually provided at this location on this plug or counter plug.

A simple configuration results when the coding element is held on a counter contact arranged in the corresponding receptacle of the counter plug. Advantageously, counter contacts are arranged in every receptacle of all counter plugs. For this reason, all counter plugs can be made identically. The allocation to the plugs takes place via the coding elements arranged on the counter plugs. The coding element fills the space of the non-provided contact at least partially and advantageously entirely. Advantageously, the coding element is made of plastic.

To prevent the intrusion of dirt, each receptacle is surrounded by a peripheral wall. When the connectors are in the connected state, the peripheral wall of each receptacle of a contact is plugged into the peripheral wall of the corresponding receptacle of a counter contact. To ensure that the plug and the counter plug can be connected notwithstanding the coding element, the external dimensions of the coding element are smaller than the inner dimensions of the peripheral wall of the receptacle of the corresponding contact. For example, for circularly-shaped cross sections, the diameters should have the corresponding dimensions.

Advantageously, the plug and the counter plug each have a plug casing or housing. On the plug casings, there are means provided which permit a connection of plug and counter plug only with an allocation of the contacts and the counter contacts. Advantageously, at least one plug and one allocated counter plug have a contact or counter contact in each receptacle. Thus, on this counter contact, there is no coding element. The allocated plug can only be plugged into a counter plug without a coding element. The number of receptacles is advantageously dependent on the maximum number of provided contacts and counter contacts.

A simple embodiment results when the plug casings of all plugs of the connector system are identical and all plug casings of all counter plugs of the connector system are identical. Thereby simple standard plugs can be used for the connector system. An allocation of plug and counter plug is nevertheless possible with a standard connector system as a result of the coding element. In particular, every plug has four receptacles for contacts and each counter plug has four receptacles for counter contacts.

It can be practical if the contacts of the plugs are configured as insert contacts and the counter contacts of the counter plugs are configured as contact sockets. The plug is therefore the plug part of the connector and the counter plug is the socket part. A simple embodiment results when the coding element is a sleeve. The sleeve is especially held on an insert contact and is advantageously pushed thereon. The coding element can, however, also be configured by a deformation of an insert contact.

A simple embodiment of the connector system results when each plug of the connector system has all insert contacts and the insert contacts are led out of the plug casing of each plug on the side facing away from the counter connector and are soldered onto the circuit board. Because all insert contacts are present in each plug, a good mechanical connection results when the insert contacts are soldered onto a circuit board. The assembly of the connector system is simplified because all plugs can be formed identically with the exception of the arrangement of one or more coding elements.

It can also be provided that the contacts of the plugs are contact sockets and the counter contacts of the counter plugs are configured as insert contacts. Accordingly, the plugs are configured as socket parts and the counter plugs are configured as plug parts. A simple embodiment results when the coding element is formed by a pin, which especially is held in a contact socket.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
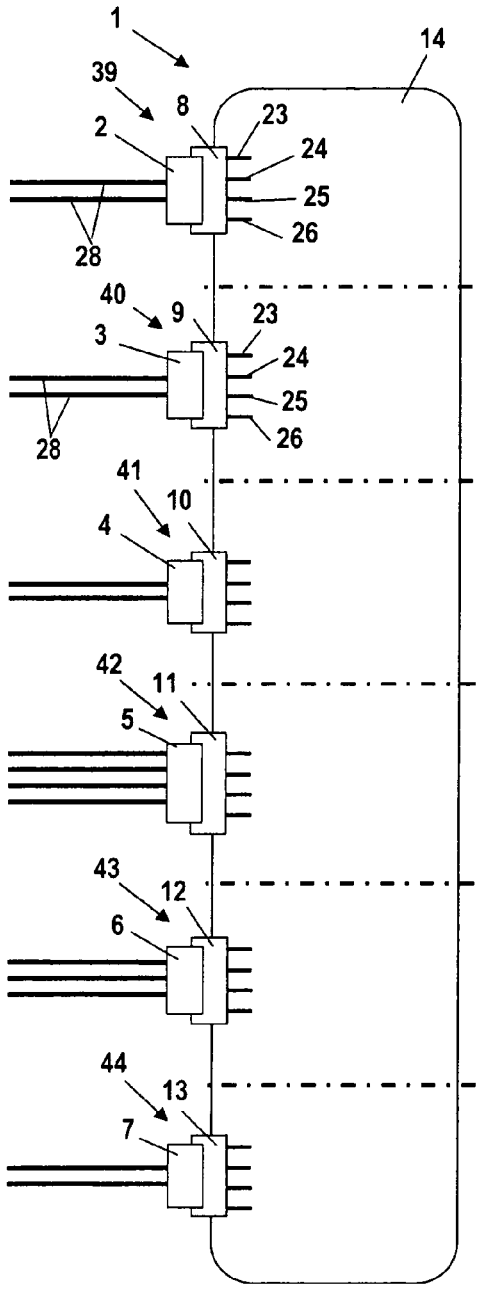
FIG. 1 is a schematic view of a connector system.

FIG. 1 schematically shows a connector system 1, which has six connectors (39, 40, 41, 42, 43, 44). Each connector 39 to 44 has a socket part (2, 3, 4, 5, 6, 7) and a corresponding plug part (8, 9, 10, 11, 12, 13). The plug parts 8 to 13 each have four plug contacts (23, 24, 25, 26) which are soldered onto the circuit board 14. Each socket part 2 to 7 has at least one connecting cable 28 which leads away from the socket parts 2 to 7 to connect with further components.

Figure 2:
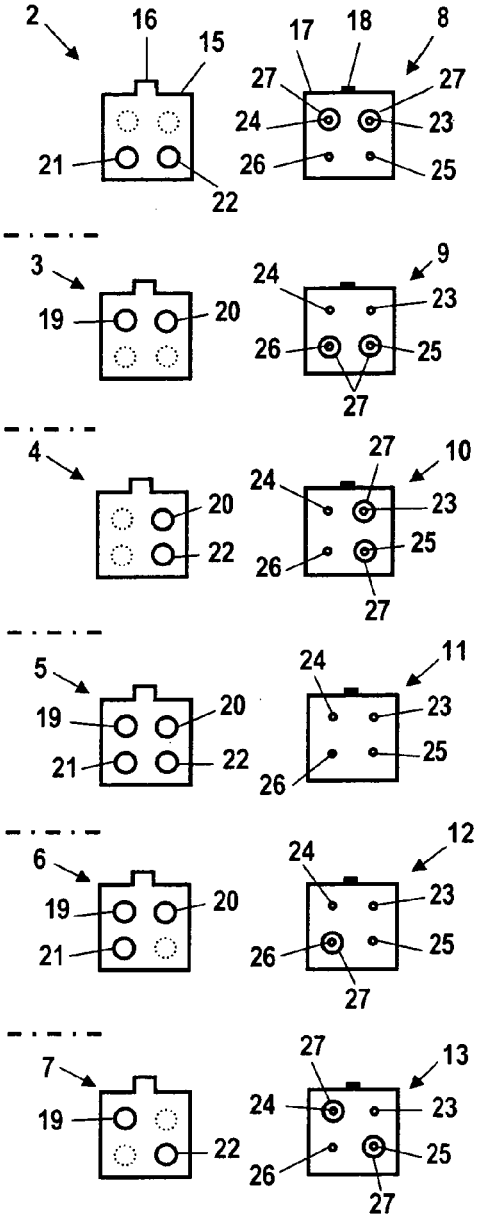
FIG. 2 is schematic top plan views of the plug parts and the socket parts of the connector system of FIG. 1.

As FIG. 2 shows, all socket parts 2 to 7 have a connector casing 15 with all connector casings 15 being configured identically. All plug parts 8 to 13 have a connector casing 17 and all connector casings 17 are identical. Each connector casing 17 has a protrusion 18 which projects into a recess 16 on the connector casing 15 of the socket parts 2 to 7 when the insert connectors 39 to 44 are in the connected state. Thus, each socket part 2 to 7 can be plugged into a plug part 8 to 13 only in one rotational position.

Each connector casing 15 of a socket part 2 to 7 can have a maximum of four contact sockets (19, 20, 21, 22). The number of contact sockets corresponds to the number of connector cables 28 of this socket part. A first contact socket 19 is allocated to a first insert contact 23 of an allocated plug part 8 to 13, a second contact socket 20 to a second insert contact 24, a third contact socket 21 to a third insert contact 25 and a fourth contact socket 22 to a fourth insert contact 26. However, in the socket parts 2 to 7, not all of the contact sockets 19 to 22 are always provided with insert contacts. Therefore, the socket part 2 only has the third contact socket 21 and the fourth contact socket 22. The receptacle spaces for the contact sockets 19 and 20 are empty and are indicated by dotted lines in FIG. 2. Sleeves 27, which effect the coding of connector 39, are arranged on the assigned insert contacts 23 and 24 of the corresponding plug part 8. As a result of the sleeves 27, no socket part can be plugged into the plug part 8 if the socket part has a first contact socket 19 or a second contact socket 20. The contact sockets (19, 20) would collide with the sleeves 27 when attempting to connect and would thereby prevent the connecting of this socket part with the plug part 8.

A socket part 3, which has a first contact socket 19 and a second contact socket 20, is provided in the connector 40. Contact sockets 21 and 22 are not provided. Sleeves 27 are arranged on the insert contacts 25 and 26 which are allocated to contact sockets 21 and 22. Because of the sleeves 27, it is not possible to insert the socket part 3 into plug part 8 or the socket part 2 into the plug part 9. Therefore, it is not possible to mix up the socket parts (2, 3) and the plug parts (8, 9) of the connectors 39 and 40.

Contact sockets 20 and 22 are provided on socket part 4. The allocated insert contacts 24 and 26 have no sleeves 27. Contact sockets 19 and 21 are not provided. The allocated insert contacts 23 and 25 carry sleeves 27.

The socket part 5 has four contact sockets 19 to 22. The allocated plug part 11 has no sleeves 27.

The socket part 6 has no fourth contact socket 22. The contact sockets 19, 20 and 21 are provided. The allocated plug part 12 has no coding elements on the insert contacts 23, 24 and 25. Only the fourth insert contact 26, which is allocated to the non-provided contact socket 22, carries a sleeve 27.

The socket part 7 has a first contact socket 19 and a fourth contact socket 22. The contact sockets 20 and 21 are not provided. Accordingly, the allocated plug part 13 has no coding elements on insert contacts 23 and 26. Sleeves 27 are provided on insert contacts 24 and 25. When connecting socket part 7 and the plug part 13, the sleeves 27 move into the space provided for the contact sockets 20 and 21.

Because of the sleeves 27, which enable a coding of connector system 1, arbitrary connecting is no longer possible. While all socket parts 2 to 7 can be connected to plug part 11, the socket part 5, however, can be connected only to plug part 11. Only if all socket parts 2 to 7 are correctly connected to plug parts 8 to 13, is it possible that each plug part 8 to 13 is connected to a socket part 2 to 7. If the connectors 39 to 44 are partially incorrectly connected, then at least one socket part 2 to 7 remains which cannot be connected. In this way, it is ensured that an incorrect connection becomes immediately apparent.

Figure 3:
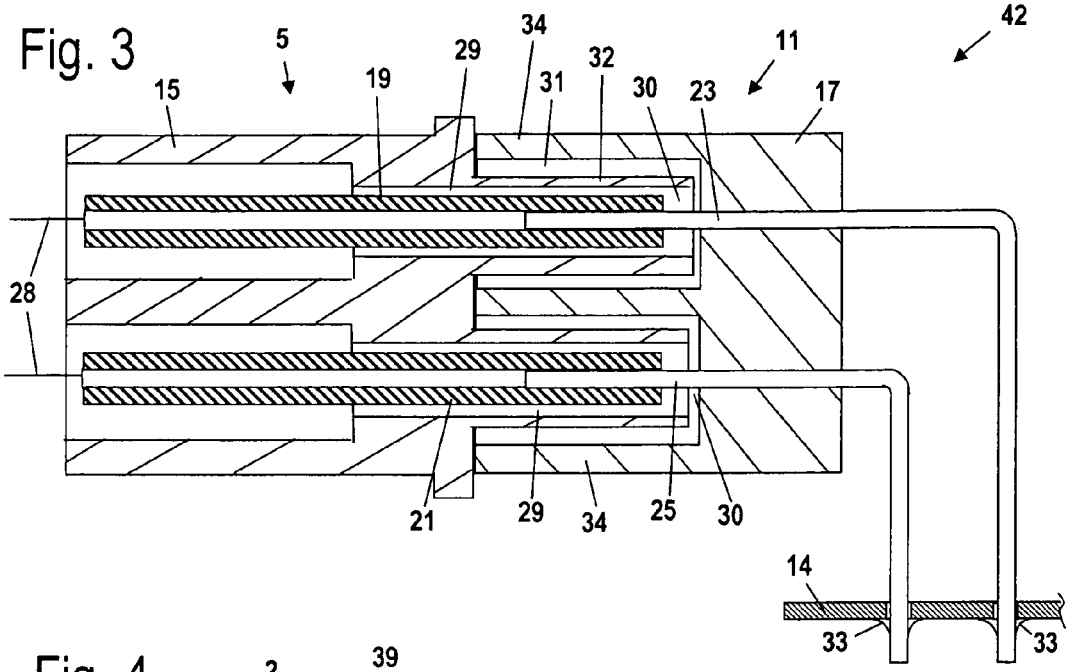
FIGS. 3 and 4 are schematic cross section views through connectors of the connector system.

FIG. 3 shows the set-up of connector 42 in detail. As FIG. 3 shows, the connector casing 15 of the socket part 5 has receptacles 29 in which contact sockets (19, 21) are arranged. The receptacles 29 are each surrounded by a separate peripheral wall 32 and are thereby protected from dirt and damage when the connector 42 is in an unconnected state. The connector casing 17 of the plug part 11 has four recesses 31 which each form a receptacle 30 for the insert contacts 23 to 26. FIG. 3 shows the insert contacts 23 and 25. In the connected state of the connector 42, the peripheral walls 32 protrude into the recesses 31 and come to rest inside the corresponding peripheral wall 34 of each receptacle 30. In the connected state, the insert contact 23 projects into the contact socket 19 and the insert contact 25 projects into the contact socket 21. As FIG. 3 shows, the insert contacts 23 and 25 are led out on the side of the connector casing 17 which faces away from the socket part 5 and, in this embodiment, are led away at an angle. The free ends of the insert contacts 23 and 25 as well as the free ends of the insert contacts 24 and 26, which are not shown in FIG. 3, are soldered onto the circuit board 14 with solder 33. The wire, which forms the insert contacts 23 to 26, serves at the same time to mechanically fix the plug part 11 and the plug parts 8 to 10, 12 and 13 are also fixed accordingly.

Figure 4:
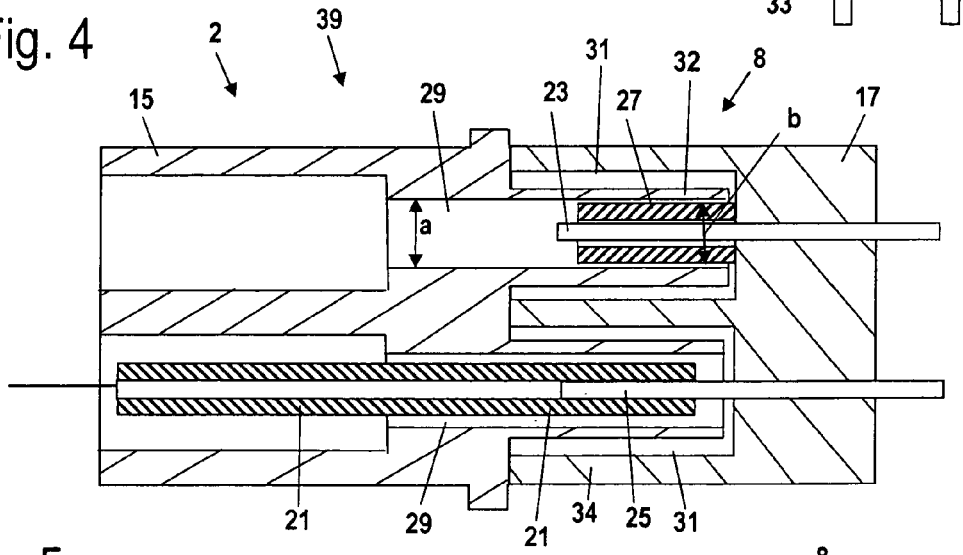

FIG. 4 shows the connector 39 in cross section. As FIG. 2 also shows, connector 39 has no contact sockets 19 or 20 arranged in the receptacles 29 for the first contact socket 19 or the second contact socket 20. The corresponding receptacles 29 are empty. Sleeves 27 are arranged in the region of the allocated insert contacts 23 and 24. As FIG. 4 shows, the sleeve 27 is inserted on the first insert contact 23. The inner diameter (a) of the peripheral wall 32 having a circular cross section is somewhat greater than the outer diameter (b) of the sleeve 27 so that the connector casing 15 can be plugged in at the connector casing 17. The peripheral wall 32 engages over the sleeve 27 and projects into the recess 31. The contact socket 21 is pushed onto the assigned insert contact 25.

Figure 5:
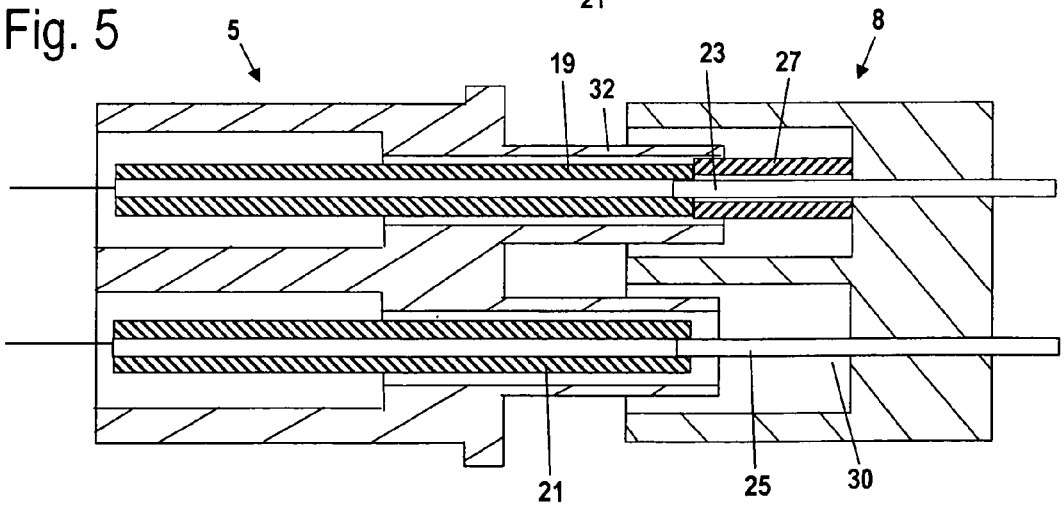
FIGS. 5 and 6 are schematic cross section views of non-connectable plug parts and socket parts; and, FIG. 7 is a schematic cross section view of an embodiment of a connector.

FIG. 5 shows a socket part 5 as it is being pushed onto the plug part 8. The first contact socket 19 is provided on the socket part 5. As FIG. 5 shows, the end face of contact socket 19 collides with the end face of the sleeve 27 before the socket part 5 is fully inserted into the plug part 8. The extent of the sleeve 27 in the insert direction is greater than the distance from the end face of the peripheral wall 32 to the base of the receptacle 30. Thereby, a complete insertion of the socket part 5 on the plug part 8 is prevented in a simple manner.

Figure 6:
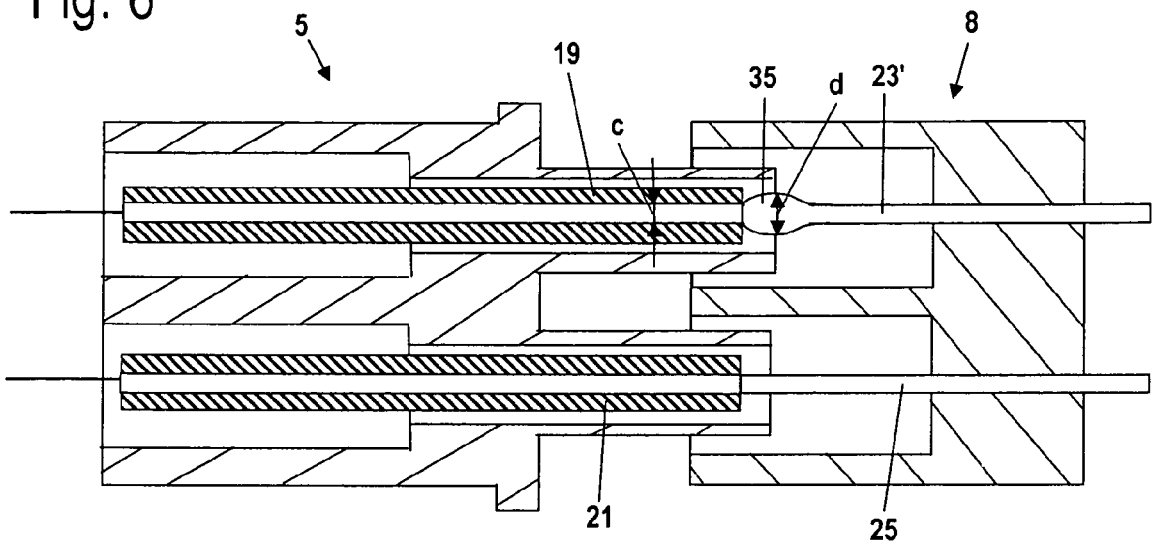

FIG. 6 shows an embodiment of plug part 8. Here, the coding element is not a sleeve 27 but an insert contact 23' having a thickening 35 which prevents socket part 5 from being pushed on. The thickening 35 can, for example, result from a permanent deformation of an insert contact 23 such as a compression or flattening. The width (d) of the thickening 35 is greater than the inner diameter (c) of the contact socket 19 so that plugging contact socket 19 onto the insert contact 23' is not possible. Therefore, it is not possible to insert socket part 5 on plug part 8.

Figure 7:
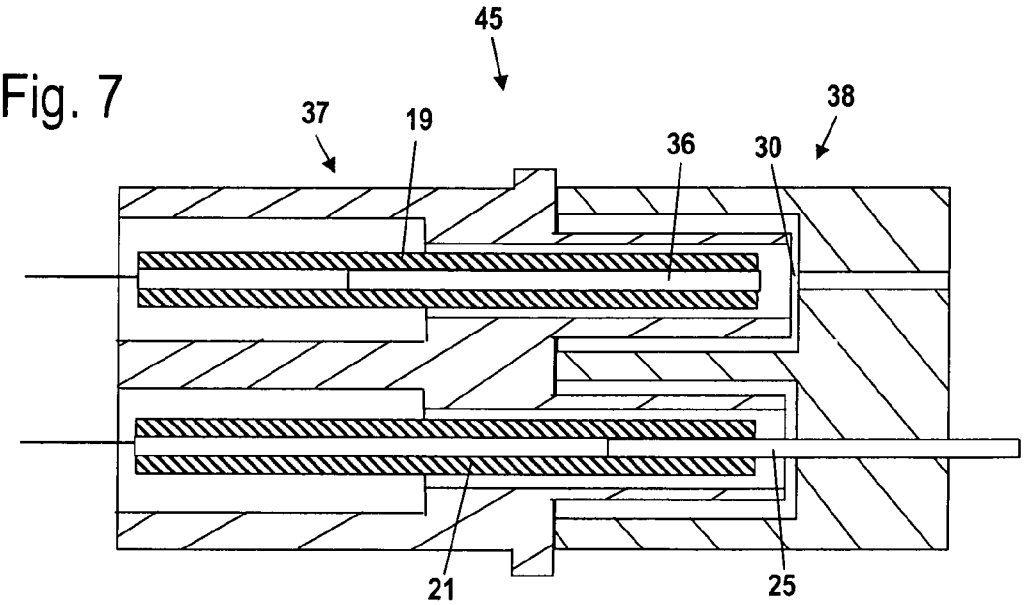

FIG. 7 shows an embodiment of a connector 45, which has a socket part 37 and a plug part 38. In the embodiment of connector 45, all contact sockets 19 to 22, of which contact sockets 19 and 21 are shown in FIG. 7, are provided. The insert contact 23, which is allocated to contact socket 19, is, however, omitted. To ensure that the socket part 37 cannot be pushed onto plug part 38 with a first insert contact 23, a pin 36 is arranged in the contact socket 19 as a coding element which prevents pushing contact socket 19 onto insert contact 23.

Advantageously, all contact sockets of all socket parts or all insert contacts of all plug parts are provided in connector system 1. A connector system 1 can, however, be provided in which not all contact sockets are present in all socket parts and not all insert contacts are present in all plug parts. Coding elements can be provided on the insert contacts as well as the contact sockets.

It is understood that the foregoing description is that of the preferred embodiments of the invention and that various changes and modifications may be made thereto without departing from the spirit and scope of the invention as defined in the appended claims.

What is claimed is:

1. A connector system comprising:

a plurality of connectors;

each of said connectors having a first plug and a second plug as a counter plug for said first plug;

each of said first plugs having a plurality of first receptacles for contacts;

each of said second plugs having a plurality of second receptacles for counter contacts;

at least one of said first receptacles of each of said first plugs having a first contact mounted therein;

at least one of said second receptacles of each of said second plugs assigned to said one of said first receptacles having a second contact mounted therein as a counter contact to said first contact;

at least one of said first receptacles of the first plug of said at least one of said connectors being without a first contact;

the one second receptacle of the second plug of said one connector corresponding to said one first receptacle having a coding element for blocking the insertion of a contact into said one second receptacle; and, said coding element being held on one of said second contacts mounted in the corresponding second receptacle of the second plug.

2. The connector system of claim 1, wherein said coding element fills out the space of a non-provided contact.

3. The connector system of claim 1, wherein said coding element is made of plastic.

4. The connector system of claim 1, further comprising:

a plurality of first peripheral walls surrounding corresponding ones of said first receptacles;

a plurality of second peripheral walls surrounding corresponding ones of said second receptacles;

the peripheral wall of each receptacle of a contact being inserted into the peripheral wall of a corresponding receptacle of a counter contact in the plugged-in state of the corresponding connector.

5. The connector system of claim 4, wherein said first and second peripheral walls have an inner diameter and said coding element has an outer diameter; and, said outer diameter of said coding element is less than said inner diameter of the peripheral wall of the corresponding contact.

6. The connector system of claim 1, wherein said first plug and second plug each have a casing; and, wherein said connector system further comprises means on said casings for permitting said first and second plugs to be connected together only when there is a single allocation of contact and counter contact.

7. The connector system of claim 1, wherein at least one of the first plugs and a second plug corresponding thereto have a contact or counter contact mounted in each receptacle.

8. The connector system of claim 1, wherein each of said first plugs and each of said second plugs has a casing; and, all of the casings of all first plugs of said connector system are identically configured and all of the casings of all second plugs are identically configured.

9. The connector system of claim 1, wherein each one of said first plugs has four of said first receptacles for first contacts and each one of said second plugs has four of said second receptacles for second contacts as counter contacts to said first contacts.

10. The connector system of claim 1, wherein said first contacts of said first plugs are configured as insert contacts and said second contacts of said second plugs are configured as contact sockets.

11. The connector system of claim 10, wherein said coding element is configured as a sleeve.

12. The connector system of claim 10, wherein said coding element is formed as a deformation of one of the insert contacts.

13. The connector system of claim 10, wherein said connector system further comprises a circuit board; each of said first plugs has a casing and a side facing away from the second plug corresponding thereto; and, said insert contacts are provided in each of said first plugs and said insert contacts pass out of the casing to said circuit board whereat said insert contacts are soldered thereto.

14. The connector system of claim 1, wherein said first contacts of said first plugs are configured as contact sockets; and, said second contacts of said second plugs are configured as insert contacts.

15. The connector system of claim 14, wherein said coding element is configured as a pin.

16. The connector system of claim 15, wherein said pin is held in a contact socket.

17. A connector system comprising:

a plurality of connectors;

each of said connectors having a first plug and a second plug as a counter plug for said first plug;

each of said first plugs having a plurality of first receptacles for contacts;

each of said second plugs having a plurality of second receptacles for counter contacts;

at least one of said first receptacles of each of said first plugs having a first contact mounted therein;

at least one of said second receptacles of each of said second plugs assigned to said one of said first receptacles having a second contact mounted therein as a counter contact to said first contact;

at least one of said first receptacles of the first plug of said at least one of said connectors being without a first contact;

the one second receptacle of the second plug of said one connector corresponding to said one first receptacle having a coding element for blocking the insertion of a contact into said one second receptacle;

said first contacts of said first plugs being configured as insert contacts and said second contacts of said second plugs being configured as contact sockets;

said coding element being configured as a sleeve; and, said sleeve being held on one of said insert contacts.

* * * * *

UNITED STATES PATENT AND TRADEMARK OFFICE

CERTIFICATE OF CORRECTION

PATENT NO. : 8,177,586 B2
APPLICATION NO. : 12/801928
DATED : May 15, 2012
INVENTOR(S) : Heiko Däschner, Rolf Walter and Michael Schneider It is certified that error appears in the above-identified patent and that said Letters Patent is hereby corrected as shown below:

On Title Page:
Under (56) References Cited:
insert -- 5,342,221 8/1994 Peterson -- and -- 6,979,233 12/2005 Waters et al --.

Signed and Sealed this
Twenty-ninth Day of January, 2013

David J. Kappos

David J. Kappos
*Director of the United States Patent and Trademark Office*